US006945475B2

(12) United States Patent
Lawrence et al.

(10) Patent No.: US 6,945,475 B2
(45) Date of Patent: Sep. 20, 2005

(54) DUAL MODE FUEL INJECTION SYSTEM AND FUEL INJECTOR FOR SAME

(75) Inventors: Keith E. Lawrence, Peoria, IL (US); Ye Tian, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 141 days.

(21) Appl. No.: 10/310,701

(22) Filed: Dec. 5, 2002

(65) Prior Publication Data

US 2004/0108394 A1 Jun. 10, 2004

(51) Int. Cl.[7] ..... F02M 59/00

(52) U.S. Cl. ..... 239/533.2; 239/533.3; 239/533.9

(58) Field of Search ..... 239/533.2–533.9, 239/533.11, 533.12; 123/467

(56) References Cited

U.S. PATENT DOCUMENTS

| | | | | |
|---|---|---|---|---|
| 2,898,051 | A | | 8/1959 | Teichert |
| 4,202,500 | A | | 5/1980 | Keiczek |
| 4,284,043 | A | | 8/1981 | Happel |
| 4,758,169 | A | | 7/1988 | Steiger |
| 4,856,713 | A | | 8/1989 | Burnett |
| 4,984,738 | A | | 1/1991 | Winquist |
| 5,458,292 | A | | 10/1995 | Hapeman |
| 5,899,389 | A | | 5/1999 | Pataki et al. |
| 6,189,817 | B1 | * | 2/2001 | Lambert ..... 239/533.2 |
| 6,220,528 | B1 | | 4/2001 | Cooke et al. |
| 6,279,840 | B1 | | 8/2001 | Buckley |
| 6,338,445 | B1 | | 1/2002 | Lambert et al. |
| 6,340,017 | B1 | * | 1/2002 | Dick ..... 123/467 |
| 6,340,121 | B1 | | 1/2002 | Lambert |
| 6,378,503 | B1 | | 4/2002 | Lambert |
| 6,422,199 | B1 | | 7/2002 | Buckley et al. |
| 6,616,070 | B1 | * | 9/2003 | Kunkulagunta ..... 239/533.12 |
| 6,637,675 | B2 | * | 10/2003 | Carroll et al. ..... 239/533.4 |
| 6,698,674 | B2 | * | 3/2004 | Dantes et al. ..... 239/585.1 |

FOREIGN PATENT DOCUMENTS

| | | |
|---|---|---|
| EP | 1 041 272 A2 | 10/2000 |
| EP | 1 069 308 A2 | 1/2001 |

* cited by examiner

*Primary Examiner*—Tu M. Nguyen
(74) *Attorney, Agent, or Firm*—Liell & McNeil

(57) ABSTRACT

A fuel injection system has the ability to produce two different spray patterns depending on the positioning of a needle control valve member. Positioning of the needle control valve member determines which of the two needle control chambers are placed in a low pressure condition. First and second needle valve members have closing hydraulic surfaces exposed to fluid pressure in the two needle control chambers. The injector preferably includes a homogenous charge nozzle outlet set and a conventional nozzle outlet set controlled respectively, by the first and second needle valve members.

20 Claims, 6 Drawing Sheets

DUAL MODE FUEL INJECTION SYSTEM AND FUEL INJECTOR FOR SAME

GOVERNMENT RIGHTS

This invention was made with U.S. Government support under DE-F05-00OR22806 awarded by the Department of Energy. The Government has certain rights in this invention.

TECHNICAL FIELD

The present invention relates generally to dual mode fuel injection systems, and more particularly to a fuel injector with the ability to produce two different spray patterns via valve control.

BACKGROUND

Over the years, engineers have been challenged to devise a number of different strategies toward the goal of a cleaner burning engine. Experience has taught that various injection timings, quantities and rates have a variety of different desirable results over the complete operating range of a given engine. Therefore, fuel injection systems with a variety of different capabilities can generally outperform fuel injection systems with narrower capability ranges, at least in their ability to reduce undesirable emissions. For instance, the leap from cam control to electronic control in fuel injection systems has permitted substantially lower emissions in several categories, including but not limited to $NO_x$, hydrocarbons and smoke.

One area that appears to show promise in reducing undesirable emissions is often referred to as homogenous charge compression ignition (HCCI). In an HCCI engine, fuel is injected early in the compression cycle to permit thorough mixing with cylinder air to idealy form a lean homogeneously mixed charge before conditions in the cylinder cause auto-ignition. Engines operating in an HCCI mode have shown relatively low outputs of undesirable emissions. Although an HCCI strategy appears promising, it has its own problems. For instance, HCCI can cause extremely high cylinder pressure rise rates and force loads, rendering it most desirable at the lower half of the engine's operating range. Many are also seeking ways to address the difficulty in controlling ignition timing in engines operating with an HCCI strategy. Thus, at this time, a pure HCCI strategy is not viable for most commercial engine applications with conventional power density requirements.

This limitation of HCCI engines has been addressed in the art by equipping an engine with an HCCI fuel injection system and a conventional fuel injection system. Although such a dual system strategy appears viable, the high expense and complexity brought by two complete injection systems renders it commercially challenged.

The present invention is directed to one or more of the problems set forth above.

SUMMARY OF THE INVENTION

In one aspect, two sets of nozzle outlets of a fuel injector are opened and closed with first and second needle valve members based upon the availability of pressurized fluid and the position of a needle control valve member. The two needle valve members have distinct closing hydraulic surfaces. With appropriate spray patterns, the fuel injector can produce both an HCCI spray pattern and a conventional injection spray pattern for a diesel engine.

In another aspect, a fuel injection system includes a plurality of fuel injectors that each include first and second needle valve members. Each of the needle valve members includes a distinct closing hydraulic surface exposed to fluid pressure in distinct needle control chambers. At least the opening of at least one of the needle valve members is controlled by a positioning of a needle control valve, which determines certain pressure conditions within the fuel injector.

In another aspect, a method of operating a fuel injection system includes a step of injecting fuel through a homogenous charge nozzle outlet set of a fuel injector. This is accomplished at least in part by placing a needle control valve in a first position. In addition, the method includes a step of injecting fuel through a conventional nozzle outlet set of the fuel injector at least in part by placing a needle control valve in a second position.

DETAILED DESCRIPTION

Figure 1:
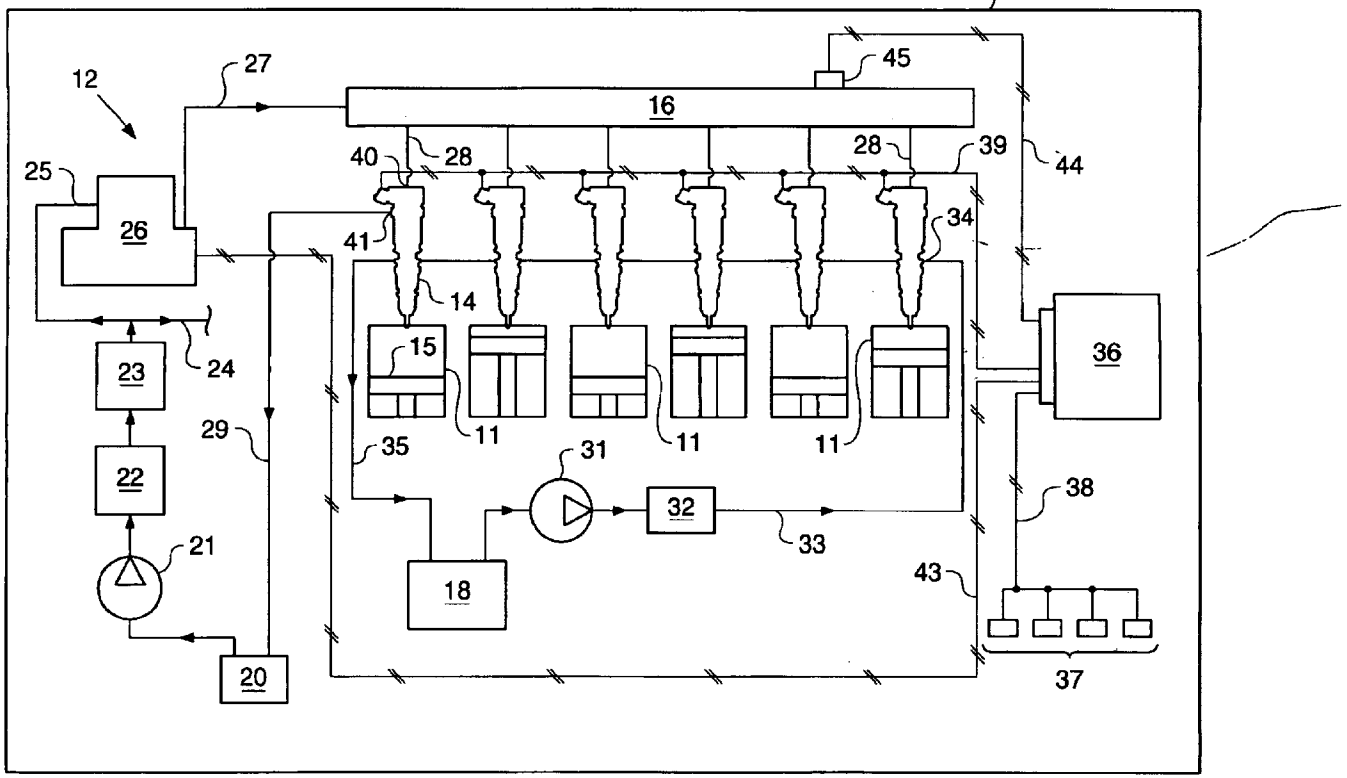
FIG. 1 is a schematic illustration of an engine and fuel injection system according to one aspect of the present invention.

Referring to FIG. 1, an engine 10 includes a fuel injection system 12 that has a common rail 16, a plurality of fuel injectors 14 and a source of fuel 18. In the illustrated example, engine 10 includes 6 cylinders 11 that each includes a reciprocating engine piston 15. Nevertheless, those skilled in the art will appreciate that the present invention is applicable to virtually any type of internal combustion engine, but is illustrated in the context of a six cylinder diesel engine. In the illustrated example embodiment, fuel injection system 12 includes hydraulically actuated fuel injectors 14 that utilize an actuation fluid that is separate from fuel. In particular, the actuation fluid circuit draws fluid from a source of actuation fluid 20, which is preferably engine lubricating oil, but could be any other suitable and available fluid including coolant, transmission fluid and even fuel. Source of fuel 18 represents a conventional fuel tank containing distillate diesel fuel. Although the present invention is illustrated in the context of a dual-fluid pressure-intensified hydraulically-actuated fuel injection system, the present invention finds potential application in a wide variety of fuel injection systems. These include but are not limited to single fluid systems that are hydraulically actuated, mechanically actuated fuel injection systems, unit pump fuel injection systems, and even common rail systems that include appropriate control features known to those skilled in the art.

Low pressure oil is pulled and circulated from the source of actuation fluid 20 by a low pressure pump 21. This relatively low pressure oil is then filtered in filter 22 and cooled in cooler 23 before branching in one direction to engine lubrication passages 24 and in another branch direction to a low pressure actuation fluid supply passage 25. Fluid supply 25 is connected to the inlet of a high pressure pump 26 that supplies high pressure actuation fluid to common rail 16 via a high pressure supply line 27. Each fuel injector 14 includes an actuation fluid inlet 40 connected to common rail 16 via a separate branch passage 28. Used actuation fluid exits fuel injectors 14 at an actuation fluid drain 41 for recirculation back to source 20 via a drain passage 29.

Pressure in common rail 16 is preferably electronically controlled by an electronic control module 36 by controlling the output of high pressure pump 26. This is preferably accomplished by matching the flow capacity of pump 26 to the flow demands of the fuel injection system 12. Control signals are communicated from electronic control module 36 to high pressure pump 26 via a communication line 43. Control of the pressure in common rail 16, is preferably accomplished via a closed loop algorithm that includes electronic control module 36 receiving common rail pressure signals via a communication line 44 from a pressure sensor 45. Thus, in the preferred system, pump output is controlled by an open loop strategy matching pump output to system demand while pressure in common rail 16 is controlled on a closed loop strategy through a comparison of desired pressure to sensed pressure. Nevertheless, those skilled in the art will appreciate that pressure in common rail 16 could be controlled in other ways known in the art.

Fuel is circulated among fuel injectors 14 by a fuel circulation pump 31 that draws fuel from source 18. After being filtered in fuel filter 32, fuel is supplied to the fuel injectors 14 via a fuel supply line 33. Fuel circulation pump 31 is preferably an electric pump that has a capacity to continuously circulate an amount of fuel to meet the maximum projected needs of the fuel injection system 12. Unused fuel is returned to source 18 via a fuel returned passage 35 in a conventional manner. Fuel injectors 14 are preferably electronically controlled by electronic control module 36 via control signals transmitted to the individual injectors via communication lines 39 in a conventional manner. In other words, control signals to the various components are based upon known sensor signals provided to electronic control module 36 from sensors 37 via communication lines 38.

Figure 2:
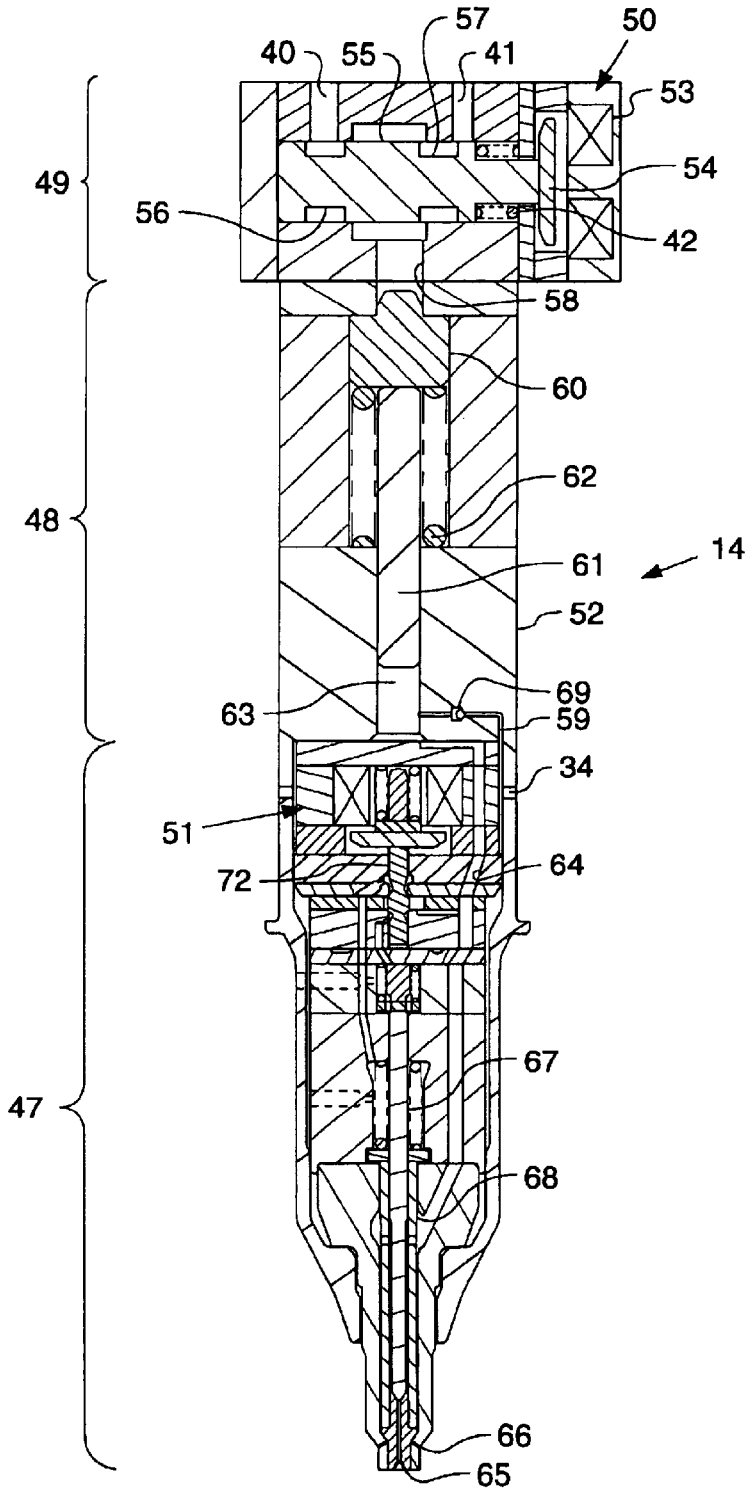
FIG. 2 is a sectioned side diagrammatic view of a fuel injector according to one embodiment of the present invention.

Referring to FIG. 2, in the preferred embodiment each fuel injector 14 includes a nozzle assembly 47, a pressure intensifier 48 and a pressure control valve 49. Those skilled in the art will appreciate that although fuel injector 14 includes a nozzle assembly 47 and pressure intensifier 48 and a pressure control valve 49 all located in the same injector body 52, these separate features could be located in separate body components. In addition, some of these features could take on different forms without departing from the intended scope of the present invention. For instance, both pressure control valve 49 and pressure intensifier 48 could be replaced with a cam driven plunger, where the cam could have one or more lobes depending upon the number of injection shots desired per engine cycle. In addition, these components could be replaced with a common rail of fuel connected to nozzle assembly 47 via a suitable valve without departing from the intended scope of the present invention. In still another variant, a unit fuel pump could be connected directly to nozzle assembly 47 or a unit oil pump could be connected to pressure intensifier 48, and still fall within the intended scope of the present invention. Thus, aspects relating to electronic control and fuel pressurization of fuel can take on a wide variety of structures without departing from the present invention.

Pressure control valve 49 includes a first electrical actuator 50, which is preferably a solenoid but could be any other suitable electrical actuator such as a piezo or a voice coil. A solenoid coil 53 is operably coupled to move an armature 54 when energized. Armature 54 is attached to, or otherwise operably coupled to move with, a pressure control valve member 55. In the illustrated embodiment, pressure control valve member 55 is a spool valve member, but those skilled in the art will appreciate that other types of valve members, such as poppet valve members, could be substituted in its place. When solenoid 50 is deenergized, a biasing spring 42 biases pressure control valve member 55 toward the left to a position that connects actuation fluid cavity 58 to low pressure actuation fluid drain 41 via an annulus 57. When solenoid coil 53 is energized, armature 54 and control valve member 55 move to the right against the action of spring 42 to open the fluid connection between actuation fluid cavity 58 and high pressure actuation fluid inlet 40 via annulus 56. When this occurs, annulus 57 closes the fluid connection between actuation fluid cavity 58 and actuation fluid drain 41. Thus, depending upon the position of pressure control valve member 55 and the energization state of solenoid 50, actuation fluid cavity 58 is either connected to high pressure actuation fluid inlet 40 to pressurize fuel within the fuel injector, or connected to low pressure actuation fluid drain 41 to allow the fuel injector to reset itself between injection events.

The pressure intensifier 48 includes a stepped top intensifier piston 60 that has a top portion exposed to fluid pressure in actuation fluid cavity 58. Although not necessary, intensifier piston 60 preferably includes a stepped top so that the high pressure actuation fluid effectively acts over only a portion of the top surface of the piston over the beginning portion of its movement. This can result in lower injection pressure over the beginning portion of a fuel injection event. Depending upon the shape and length of the stepped top, other front end rate shaping forms can also be produced, including but not limited to ramp front ends and boot shaped front end rate shaping. Intensifier piston 60 is biased upward toward its retraced position, as shown, by a return spring 62. Between injection events, when intensifier piston 60 is retracting under the action of spring 62, used actuation fluid is expelled from actuation fluid cavity 58 to actuation fluid drain 41. A plunger 61 is operably coupled to move with intensifier piston 60 to pressurize fuel in a fuel pressurization chamber 63, when undergoing its downward pumping stroke. When plunger 61 and intensifier piston 60 are retracting, fresh low pressure fuel is pushed into fuel pressurization chamber 63 via a low pressure fuel circulation passage 59 and passed a check valve 69. Low pressure fuel circulation passage 59 is fluidly connected to fuel inlet 34 via the annular space created by the clearance between the injector body casing and the injector stack of components inside the same. Because intensifier piston 60 has a larger diameter than plunger 61, fuel pressure in fuel pressurization chamber 63 can be raised to several times that of the actuation fluid pressure contained in common rail 16 (FIG. 1).

Figure 3:
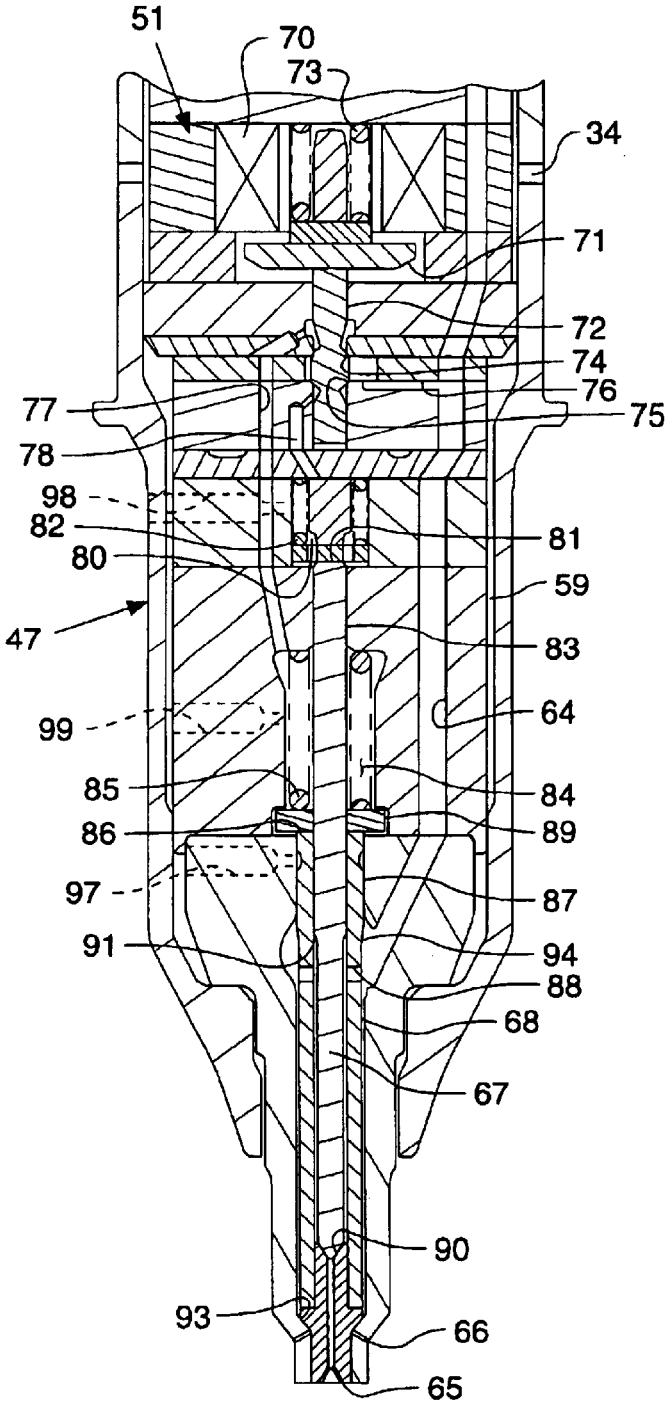
FIG. 3 is a sectioned side diagrammatic view of the nozzle assembly portion of the fuel injector of FIG. 2.

Referring in addition to FIG. 3, nozzle assembly 47 includes a nozzle supply passage 64 extending between fuel pressurization chamber 63 and a homogenous charge nozzle outlet set 65 and a conventional nozzle outlet set 66. The opening and closing of nozzle outlet sets 65 and 66 are controlled by a first needle valve member 67 and a second needle valve member 68, respectively. When plunger 61 is undergoing its downward pumping stroke, nozzle supply passage 64 can be considered to be a high pressure passage containing fuel at injection pressure levels. Which of the homogenous charge nozzle outlet set 65 or the conventional nozzle outlet set 66 will open during an injection event depends upon the positioning of a needle control valve member 72, which is operably coupled to a second electrical actuator 51. Homogenous charge nozzle outlet set 65 includes one or more nozzle outlets that are oriented at a relatively low angle with respect to the centerline of the fuel injector. Those skilled in the art will appreciate that homogenous charge nozzle outlet set are oriented in a way to produce mixing of fuel and air while the engine piston is undergoing its compression stroke. Conventional nozzle outlet set 66 includes one or more nozzle outlets oriented at a relatively high angle with respect to the injector body centerline in a conventional manner.

The first needle valve member 67 includes a closing hydraulic surface 81 exposed to fluid pressure in a first needle control chamber 80, and an opening hydraulic surface 91 exposed to fluid pressure in nozzle supply passage 64 via fluid connection passage 88. First needle valve member 67 is biased toward a downward position in contact with first valve seat 90 to close homogenous charge nozzle outlet set 65 by a first biasing spring 82, which is located in first needle control chamber 80.

The second needle valve member 68 includes a second closing hydraulic surface 86 exposed to fluid pressure in a second needle control chamber 84, and an opening hydraulic surface 94 exposed to fluid pressure in nozzle supply passage 64. Second needle valve member 68 is normally biased downward into contact with second needle seat 93 to close conventional nozzle outlet set 66 via the action of second biasing spring 85. In addition, second needle valve member 68 is biased downward into contact with second needle seat 93 via first needle valve member 94 pushing against first valve seat 90 via the action of first biasing spring 82. The strengths of springs 82 and 85 as well as the sizing of opening hydraulic surfaces 91 and 94 are preferably such that both the first and second needle valve members have similar valve opening pressures. Nevertheless, those skilled in the art will appreciate that these aspects could be varied to produce different valve opening pressures for the two different needle valve members to produce some desired effect. Those skilled in the art will appreciate that second needle valve member 68 includes at least two separate but attached components. As used in this patent, a valve member of any type can be one or more components that are attached, or otherwise coupled, to move together as a single unit. The maximum upward travel distance of needle valve member 67 is determined by the spacer thickness portion and stop piece portions of first needle valve member, which are located in first needle control chamber 80. The maximum upward travel distance of needle valve member 68 is determined by the spacer 89, which is preferably a thickness category part. First needle control chamber 80 is substantially fluidly isolated from second needle control chamber 84 by a guide portion 83. Likewise, second needle control chamber 84 is substantially fluidly isolated from nozzle supply passage 64 via a guide region 87.

The positioning of needle control valve member 72 determines which of the needle control chambers 80 or 84 is connected to the high pressure in nozzle supply passage 64 and hence which of the needle valve members 67 or 68 will lift to an open position during an injection event. Second electrical actuator 51 is preferably operably coupled to needle control valve member 72 via connection to an armature 71. Second electrical actuator 51 is shown as a solenoid but could be any other suitable electrical actuator including but not limited to a piezo or a voice coil. Needle control valve member 72 is normally biased downward into contact with second valve seat 75 via a biasing spring 73. When in this position, second needle control chamber 84 is fluidly connected to nozzle supply passage 64 via a pressure communication passage 77, past a first valve seat 74 and via a connection passage 76. When in this position, first needle control chamber 80 is fluidly isolated from nozzle supply passage 64 due to the closure of second valve seat 75. In the preferred embodiment, first needle control chamber 80 is a closed volume except for second pressure communication passage 78. However, in some instances, it may be desirable to connect first needle control chamber 80 to annular low pressure fuel circulation passage 59 via a restricted vent passage 98 (shown in shadow of FIG. 3). The inclusion of an unobstructed but restrictive vent passage 98 might be desirable in those cases where leakage of high pressure fuel into first needle control chamber 80 during an injection event is sufficient to cause first needle valve member 67 to be closed prematurely. When vent passage 98 is not included, first needle valve member 67 can lift to its upward open position into the relatively closed volume of first needle control chamber 80, since the same will be at low pressure if an injection event is initiated when second electrical actuator 51 is deenergized. Preferably, vent passage 98 is omitted and the reduction in volume of the needle control chamber 80 caused by lofting of needle valve member 67 is accommodated by the compressibility of the fuel.

If second electrical actuator 51 is energized, solenoid coil 70 attracts armature 71 and lifts needle control valve member 72 upward to close first valve seat 74 and open second valve seat 75. When this occurs, first needle control chamber 80 becomes fluidly connected to high pressure in nozzle supply passage 64 to prevent first needle valve member 67 from lifting off of first needle seat 90 due to the high pressure hydraulic force acting on closing hydraulic surface 81. Provided second electrical actuator 51 is energized before fuel pressure and nozzle supply passage 64 has increased for an injection event, low pressure will exist in second needle control chamber 84 due to the closure of valve seat 74. Preferably, second needle control chamber 84 is a closed volume except for pressure communication passage 77, but could be connected to low pressure fuel circulation passage 59 via an unobstructed but restricted vent passage 99 in the event that fuel leakage between the various components is a concern. When second needle control chamber 84 is at low pressure and fuel pressure in nozzle supply passage 64 increases to injection levels and acts upon opening hydraulic surface 94, second needle valve member 68 will lift upward to open conventional nozzle outlet set 66 to nozzle supply passage 64. Those skilled in the art will appreciate that when second valve member 68 lifts to its open position, it also lifts first needle valve member 67, but homogenous charge nozzle outlet set 65 remains blocked since first needle valve member 67 remains in contact to close first needle seat 90. Vent passage 99 is preferably omitted, but can be included if leakage and/or fluid displacement caused by moving the needle valve member to an open position produce a need for a vent. In addition or alternatively, a vent passage 97, which connects to an annulus is outer needle valve member 68, can be used to control leakage flow.

Figure 4:
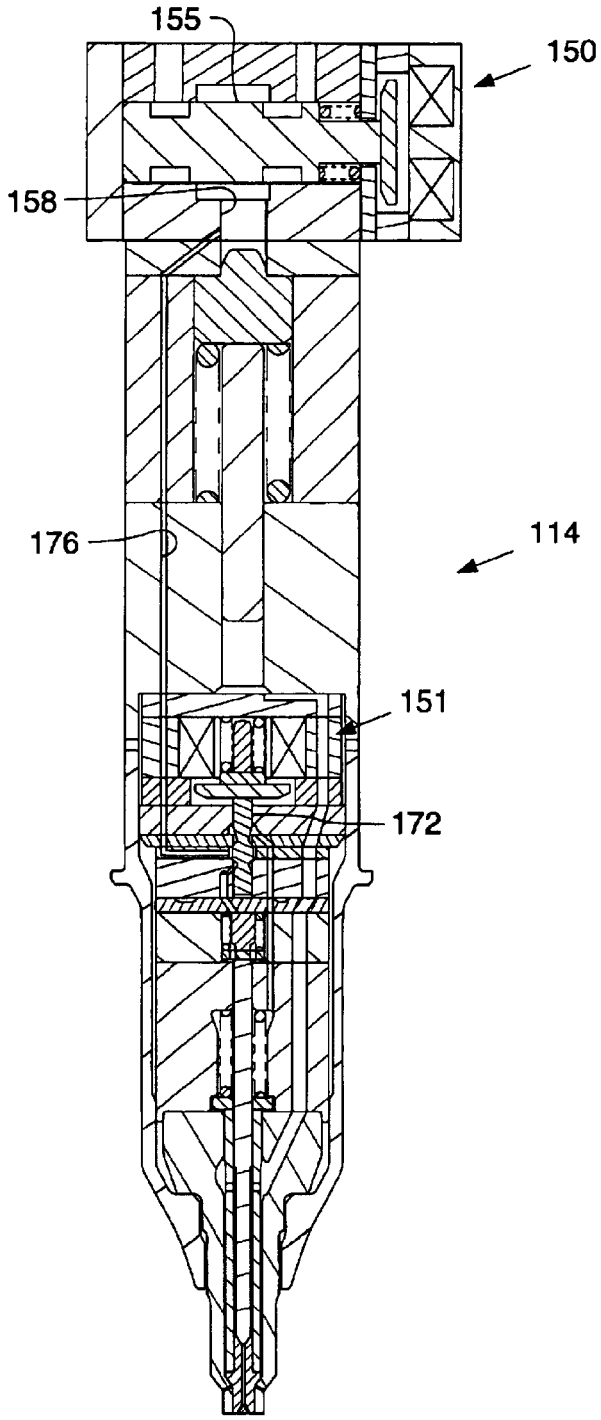
FIG. 4 is a sectioned side diagrammatic view of a fuel injector according to another embodiment of the present invention.

Referring now to FIG. 4, a hydraulically actuated fuel injector 114 is very similar to that shown in FIG. 2 except that it includes a connection passage 176 connected to the actuation fluid cavity 158 rather than a connection passage 76 fluidly connected to the nozzle supply passage 64 as shown in the embodiment of FIG. 2. Thus, in the embodiment of FIG. 4, actuation fluid is channeled to the needle control chambers based upon the positioning of needle control valve member 172, based upon the energization state of electrical actuator 151. Like the embodiment of FIG. 2, the pressure control valve member 155, which controls the pressure in actuation fluid cavity 158 is controlled in its position by a first electrical actuator 150. Thus, the embodiment of FIG. 4 is virtually identical to that of the embodiment of FIG. 2 except that high pressure or low pressure oil is applied to the closing hydraulic surfaces of the needle valve members rather than fuel pressure as in the embodiment of FIG. 2.

Figure 5:
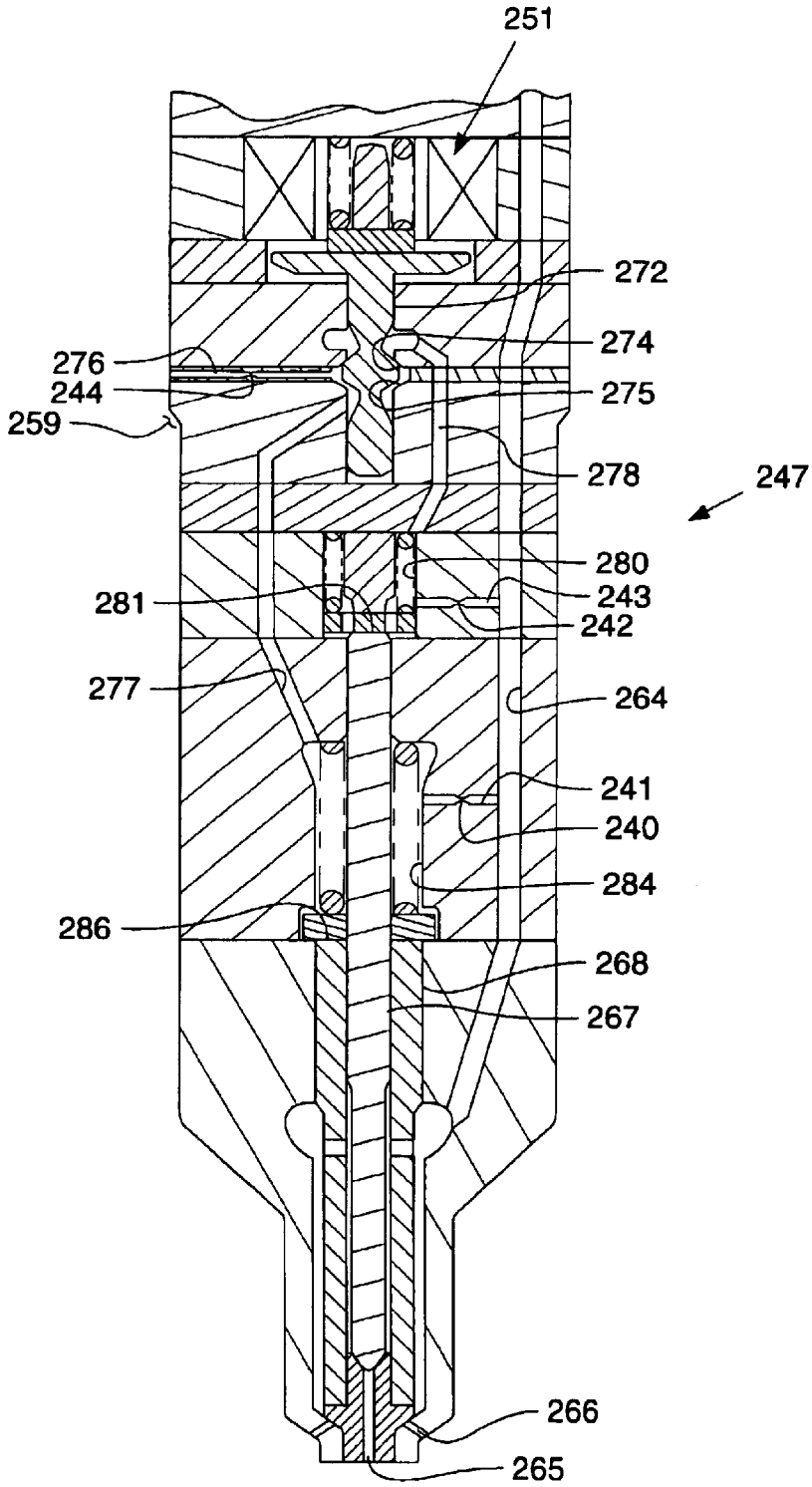
FIG. 5 is a sectioned side diagrammatic view of a fuel injector nozzle assembly according to another embodiment of the present invention.

Referring now to FIG. 5, a nozzle assembly 247 could be substituted in place of the nozzle assembly 47 shown in the embodiment of FIG. 2, or could be a stand alone fuel injector within a different type of fuel injection system that includes a means other than that shown in FIGS. 1 and 2 for pressurizing fuel and controlling the flow of same to the fuel injector. This embodiment differs from the nozzle assembly 47 shown in FIG. 3 in that its connection passage 276 is fluidly connected to the low pressure fuel circulation area 259 rather than a connection passage 76 fluidly connected to the nozzle supply passage 64 as in the FIGS. 2–3 embodiment. Thus, in this embodiment the needle control valve member 272 moves between first valve seat 274 and second valve seat 275 to connect either first needle control chamber 280 or second needle control chamber 284 to low pressure fuel passage 259. In this embodiment, first needle control chamber 280 is fluidly connected to nozzle supply passage 264 via an unobstructed connection passage 243 that includes a flow restriction 242, which is more restrictive than a flow restriction 244 located in vent connection passage 276. Because of these flow restrictions and the various passageways, first needle control chamber 280 will drop to a relatively low pressure when needle control valve member 272 is in its downward position opening first valve seat 274. In other words, pressure in first needle control chamber 280 will be somewhere between that in nozzle supply passage 264 and low pressure fuel circulation passage 259. Because flow restriction 242 is more restrictive that flow restriction 244 when in this position, first needle control chamber 280 will be at a relatively low pressure since it is fluidly connected to low pressure fuel circulation passage 259 via pressure communication passage 278 and vent connection passage 276.

When electrical actuator 251 is energized to lift needle control valve member 272 upward to open second valve seat 275, second needle control chamber 284 becomes fluidly connected to low pressure fuel circulation passage 259 via pressure communication passage 277 and vent connection passage 276. When this occurs the pressure in needle control chamber 284 will be somewhere between that in nozzle supply passage 264 and fuel circulation passage 259, since second needle control chamber 284 is fluidly connected via an unobstructed connection passage 241 to nozzle supply passage 264. However, because flow restriction 240 is more restrictive than flow restriction 244, pressure in second needle control chamber 284 will drop when needle control valve member 272 is in its upward position opening seat 275. Like the earlier embodiments, a first needle control valve member 267 controls the opening and closing of a homogenous charge nozzle outlet set 265. First needle valve member 267 includes a closing hydraulic surface 281 exposed to fluid pressure in first needle control chamber 280. The second needle valve member 268 controls the opening and closure of conventional nozzle outlet set 266. Second needle valve member 268 includes a closing hydraulic surface 286 exposed to fluid pressure in second needle control chamber 284.

Those skilled in the art will appreciate that all of the illustrated embodiments show a first needle valve member at least partially positioned within the second needle valve member in a concentric relationship. In addition, the valve seat for the first needle valve member is located on an inner surface of the second needle valve member. Those skilled in the art will appreciate that the nested relationship between the two needle valve members is preferable but not absolutely necessary. In other words, the two needle valve member should be located in some other spatial relationship with respect to one another and the injector body without departing from the intended scope of the present invention.

INDUSTRIAL APPLICABILITY

Referring now to FIGS. 1–3 and the graphs of FIGS. 6*a*–6*e*, a sample injection sequence according to the present invention will be described. Prior to the beginning of an injection sequence, first and second electrical actuators 50 and 51 are deenergized and low pressure prevails throughout fuel injector 14. In other words, pressure control valve member 55 is biased to a position that connects actuation fluid cavity 58 to low pressure drain outlet 41. In addition, plunger 61 and intensifier piston 60 are in their retracted positions and fuel pressurization chamber 63 is at low pressure as being fluidly connected past check valve 69 to low pressure fuel circulation passage 59. This also results in nozzle supply passage 64 and the various passages associated with the needle control valve to be at low pressure. In the preferred version of the present invention, the two different nozzle outlet sets are preferably configured for homogenous charge compression ignition injection and conventional fuel injection. Thus, somewhere after the engine piston 15 begins its upward compression stroke but preferably when the piston is closer to a bottom dead center position than a top dead center position, a homogenous charge injection event is desirable. In such a case, the fuel is injected early, and the fuel spray is pointed relatively downward into the engine cylinder 11 to promote the best possible mixing over the time period when the engine piston completes its compression stroke.

Figures 6A, 6B, 6C, 6D, 6E:
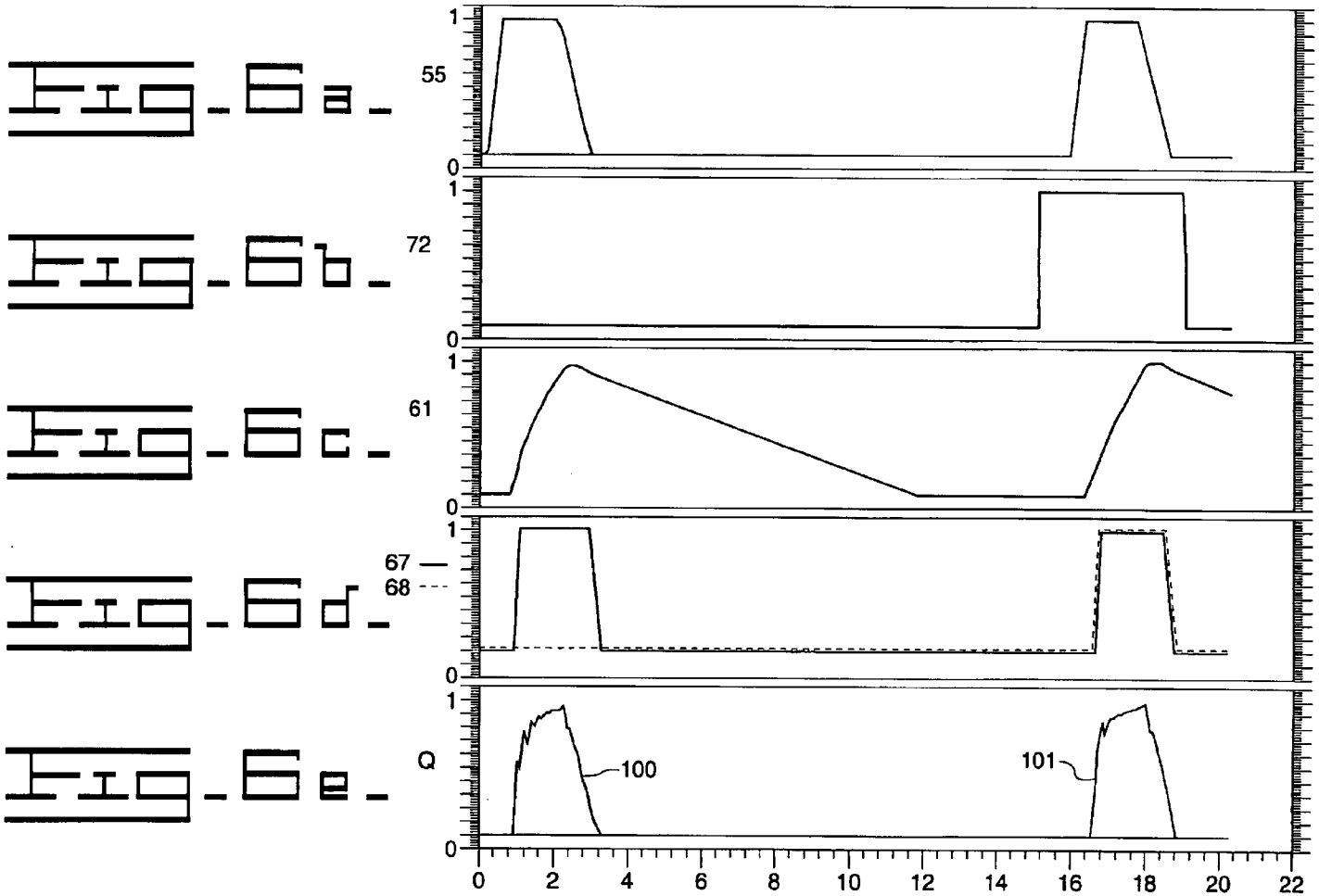
FIGS. 6*a*–6*e* are graphs of pressure control valve member position, needle control valve member position, plunger position, first and second needle valve member positions and fuel injection rate verses time for an example injection sequence according to the present invention.

Shortly before the desired timing for a homogenous charge compression injection event 100 as shown in FIG. 6*e*, current is supplied to electrical actuator 50 to move pressure control valve member 55 rightward to close low pressure drain 41 and open actuation fluid cavity 58 to high pressure actuation fluid inlet 40. When this occurs, high pressure actuation fluid flows into fuel injector 14 and acts upon intensifier piston 60 causing it and plunger 61 to move downward to pressurize fuel in fuel pressurization chamber 63. This is shown by the beginning upward slope in FIG. 6*c*, but movement of the pressure control valve member from a closed position to an open position is shown in FIG. 6*a*. Downward movement of plunger 61 quickly causes fuel pressure in fuel pressurization chamber 63 to rise to injection levels. As pressure rises in nozzle supply passage 64, high pressure is communicated to second needle control chamber 84 via connection passage 76 and first pressure communication passage 77. As such, the second needle valve member 68 will remain in a downward closed position as shown in the dotted line of FIG. 6*d*. However, because first needle control chamber 80 is at low pressure due to the closure of second valve seat 75, first needle valve member 67 will lift upward to open homogenous charge nozzle outlet set 65 when fuel pressure exceeds a valve opening pressure sufficient to overcome the biasing spring 82. This opening of first needle valve member 67 is shown with the solid line in FIG. 6*d*. As expected, as the first needle valve member lifts to an open position, fuel commences to spray for the homogenous charge injection event 100 shown in FIG. 6*e*. Shortly before the desired amount of fuel has been injected, the homogenous charge injection event 100 is ended by deenergizing electrical actuator 50 to relieve pressure on intensifier piston 60 by opening actuation fluid cavity 58 to low pressure drain 41. When this occurs, the downward motion of plunger 61 and intensifier piston 60 ceases and the two will begin to retract at a rate influenced by the strength of return spring 62. This retraction is shown in FIG. 6*c* by the relatively long sloped portion of the plunger's movement. When plunger 61 slows and eventually stops in its downward movement, fuel pressure in fuel pressurization chamber 63 and nozzle supple passage 64 quickly drops also. When the fuel pressure drops below a valve closing pressure, first needle valve member 67 moves downward to close homogenous charge outlet set 65 under the action of biasing spring 82. With the seating of first needle valve member 67 on valve seat 90, the homogenous charge injection event 100 is completed. The fuel injector then has the ability to reset itself with the retraction of plunger 61 and intensifier piston 60 as the injected fuel mixes with air in the engine cylinder during the compression stroke. If nothing further were done, the homogenous charge would auto-ignite in the engine cylinder 15 when the engine piston is in the region of top dead center position.

Those skilled in the art will appreciate that any number of homogenous charge compression events can be performed at desired timings. Depending upon the structure of the particular fuel injector and fuel injection system, the homogenous charge injection event can be ended in more than one way. In the first way, the first electrical actuator 50 is deenergized to reduce fuel pressure below a valve closing pressure causing the first needle valve member 67 to move downward toward its closed position under the action of its biasing spring 82. In the event that vent passages 98 and 99 are not used, the homogenous charge injection event can also be ended by energizing second electrical actuator 51 to end the injection event while fuel pressure is still relatively high. In such a case, upward movement of the needle control valve member 72 will trap high pressure in second needle control chamber 84 causing second needle valve member 68 to remain in its downward closed position. However, upward movement of needle control valve member 72 will open seat 75 and connect first needle control chamber 80 to the high pressure fluid in nozzle supply passage 64 causing the first needle valve member 67 to abruptly close under the action of hydraulic pressure and its biasing spring 82. Those skilled in the art will also appreciate that various end of injection rate shaping can be performed in the event that the fuel injector has a structure shown in FIG. 2 that does not include vents 98 or 99 as shown within hidden lines of FIG. 3. In other words, timing in the deenergization of first electrical actuator 50 relative to the de-energization of the second electrical actuator 51 can be adjusted to cause the first needle valve member 67 to move toward a closed position anywhere between maximum fuel pressure and the valve closing pressure defined by biasing spring 82.

In the illustrated example injection sequence of FIGS. 6*a–e*, the homogenous charge injection event 100 is followed at a later time with a conventional injection event 101. In order to produce conventional injection event 101, the second electrical actuator 51 is preferably energized before fuel pressure in injector 14 reaches the valve opening pressure of the first needle valve member 67. In the graph of FIGS. 6*a* and 6*b*, the second electrical actuator is energized before the first electrical actuator 50. By doing so, needle control valve member moves upward to close first valve seat 74 and open second valve seat 75. This results in second needle control chamber 84 being trapped with low pressure whereas first needle control chamber 80 becomes fluidly connected to nozzle supply passage 64 via connection passage 76 and pressure communication passage 78. However, those skilled in the art will appreciate that mere movement of the needle control chamber before the fuel injector is pressurized results in both the first and second needle valve member 67 and 68 remaining in their downward closed positions. Shortly before the desired beginning of the conventional injection event 101, first electrical actuator 50 is energized to connect actuation fluid cavity 58 to high pressure actuation fluid inlet 40. Like before, high pressure actuation fluid acts upon intensifier piston 60, and plunger 61 is driven downward to pressurize fuel in fuel pressurization chamber 63. As fuel pressure rises, this pressure is communicated to first needle control chamber 80 and acts upon closing hydraulic surface 81 to maintain first needle valve member 67 in contact with valve seat 90 to close or block homogenous charge nozzle outlet set 65. However, this same rise in fuel pressure acts upon the opening hydraulic surface 94 of second needle valve member 68 causes it to lift both needle valve members upward to open conventional nozzle outlet set 66 when the fuel pressure exceeds a valve opening pressure, which is related to the sizing of various hydraulic surfaces and springs 82 and 85. This lifting of both needle valve members to open the conventional nozzle outlet set 66 is shown in FIG. 6*d*. Shortly before the desired end of the conventional injection event, first electrical actuator 50 is deenergized to move pressure control valve member 55 back to a position that connects actuation fluid cavity 58 to low pressure actuation fluid drain 41. This results in plunger 61 and intensifier piston 60 coming to a stop and eventually beginning to retract as shown in FIG. 6*c*. By slowing and ceasing the downward movement of plunger 61, fuel pressure in fuel pressurization chamber 63 and nozzle supply passage 64 quickly drops below a valve closing pressure that causes first and second needle valve members to move downward together to close valve seat 93 and block conventional nozzle outlet set 66. This aspect is shown in FIG. 6*d*. With the closure of seat 93, the conventional injection event 101 ends. Sharper closing of the outer needle 68 can be accomplished by cutting current to valve 51 before valve 50. Sometime after fuel pressure has dropped below the valve opening pressure for the first needle valve member 67, and preferably after the first electrical actuator 50 is deenergized, the second electrical actuator 51 is deenergized to return needle control valve member 72 to its downward position.

Those skilled in the art will appreciate that if the needle control chambers 80 and 84 are not vented as shown in shadow with vents 98 and 99 in FIG. 3, the conventional injection event can be ended in another way. In other words, the conventional injection event can be ended by deenergizing second electrical actuator 51 in order to apply high pressure fuel to the closing hydraulic surface 86 of second needle valve member 68. When this occurs, the high pressure fuel acting on both closing hydraulic surface 81 and closing hydraulic surface 86 cause both needle valve member 67 and 68 to move downward to close conventional nozzle outlet set 66. Thus, this aspect of the invention can permit for some end of injection rate shaping of a type previously described so that the fuel pressure at the end of injection, when the needle valve member begins moving toward a closed position, can be chosen between maximum injection pressure and the valve closing pressure of the needle valve member. Although only a single conventional injection event was shown, those skilled in the art will appreciate that the present invention can accomplish a plurality of conventional injection events at desired timings.

The fuel injector of FIG. 4 operates in a similar manner except injection events are begun and ended by energizing or deenergizing first electrical actuator 150. In other words, regardless of whether either of the needle control chambers is vented to a low pressure area, each injection event is begun by energizing first electrical actuator 150 and ended by deenergizing the same. In the structure shown in FIG. 4, the second electrical actuator 151 acts as a switch to determine which type of injection will take place. If the second electrical actuator 151 is deenergized, a homogenous charge injection event will occur. If second electrical actuator 151 is energized before electrical actuator 150, a conventional injection event will occur. The embodiment of FIG. 4 also has the ability to end either of the injection events by changing the energization state of second electrical actuator 151 as described in relation to the un-vented version of fuel injector 14.

Referring now to FIG. 5, an injection event will be initiated when nozzle supply passage 64 is connected to a source of high pressure fuel. This high pressure fuel can come from a common rail, from underneath a cam actuated plunger, from a unit pump or from a fuel pressurization chamber of a type shown in FIG. 2. Assuming that nozzle assembly 247 is substituted in place of nozzle assembly 47 of FIG. 2, a homogenous charge injection event is initiated by energizing first electrical actuator 50 to open actuation fluid cavity 58 to high pressure actuation fluid 40. This causes piston 60 and plunger 61 to move downward to pressurize fuel in fuel pressurization chamber 63 and nozzle supply passage 264. Second electrical actuator 251 remains in an un-enerigized state such that needle control valve member 272 closes second seat 275 but opens first seat 274. When in this position, first needle control chamber 280 is fluidly connected to low pressure fuel passage 259 via pressure communication passage 278 and connection passage 276. Because the flow restriction 242 is more restrictive than the flow restriction 244, pressure in needle control chamber 280 will increase but remain low relative to the high pressure fuel in nozzle supply passage 264. This will allow first needle valve member 267 to lift upward to open homogenous charge outlet set 265 when fuel pressure exceeds a valve opening pressure. On the other hand, second needle valve member 268 will remain in the downward position blocking conventional nozzle outlet set 266 since seat 275 is closed, resulting in second needle control chamber 284 rising in pressure to high levels associated with nozzle supply passage 264. Shortly before the desired end of the homogenous charge injection event, the first electrical actuator 50 is deenergized causing fuel pressure to drop throughout the fuel injector below valve closing pressures that result in first needle valve member 267 moving downward to close homogenous charge nozzle outlet set 265 under the action of its biasing spring.

A conventional injection event is accomplished by energizing second electrical actuator 251 before fuel pressure rises substantially in nozzle assembly 247, and preferably before energizing first electrical actuator 50. When this occurs, first valve seat 274 becomes closed and second valve seat 275 is opened. When is occurs, second needle control chamber 284 is fluidly connected to low pressure fuel passage 259 via pressure communication passage 277 and connection passage 276. However, first needle control chamber 280 is only connected to nozzle supply passage 264 via passage 243. Because flow restriction 240 is preferably more restrictive than flow restriction 244, a rise in pressure in nozzle supply passage 264 will result in fuel pressure in second needle control chamber 284 remaining relatively low. As such, second needle valve member 268 will lift to its open position to open conventional nozzle outlet set 266 when fuel pressure in nozzle supply passage 264 exceeds a valve opening pressure. The conventional injection event is ended by deenergizing first electrical actuator 250 to reconnect actuation fluid cavity 58 to low pressure drain passage 41. This causes a drop in fuel pressure throughout the fuel injector causing second needle valve member 268 and first needle valve member 267 to move downward in unison to close conventional nozzle outlet set 266 to end the conventional injection event.

Those skilled in the art will appreciate that in all the different versions of the present invention, each homogenous charge injection event is initiated by placing the needle control valve in a first position. This first position preferably corresponds to a position in which the needle control chamber associated with the first needle valve member is allowed to stay at a relatively low pressure throughout the injection event. This can be accomplished by isolating that needle control chamber from high pressure fuel as in the embodiment of FIG. 2, by isolating the first needle control chamber to high pressure fuel and venting the same via an optional vent passage 98 as shown in FIG. 3, or by isolating the first needle control chamber to high pressure fuel and connecting the same to a vent via the needle control valve as shown in the embodiment of FIG. 5. Thus, when the needle control valve member is in its first position, the first needle control chamber is fluidly connected to at least one of a low pressure passage and a high pressure passage. Depending upon the structure of the individual injector, the first needle control chamber could be fluidly connected to the nozzle supply passage via an unobstructed passage as shown in FIG. 5, be fluidly connected to low pressure fuel circulation passage via an unobstructed vent passage 98 as shown in hidden lines in FIG. 3, or not connected at all to either the nozzle supply passage or the low pressure passage except through the needle control valve.

When it is desired to perform a conventional injection event, the needle control valve member is moved to a position that allows the second needle control chamber to be at a relatively low pressure during the injection event. This permits the second needle valve member to lift to an open position to open the conventional nozzle outlet set. In the case of the embodiment shown in FIG. 2, this results in the first needle control chamber being fluidly connected to the high pressure nozzle supply passage 64, and the second needle control chamber 84 being isolated from the high pressure via a closure of second valve seat 75. In the embodiment of FIG. 3, movement of the needle control valve member 72 causes second needle control chamber 84 to be isolated from the high pressure in nozzle supply passage 64 but connected to low pressure fuel supply passage 59 via the optional unobstructed vent passage 99. In the embodiment shown in FIG. 5, the conventional injection event is also initiated by moving the needle control valve member 272. However, in this case, this causes second needle control chamber 84 to be fluidly connected to both nozzle supply passage 264 and low pressure fuel passage 259, but the existence of flow restriction 240 and 244 cause the pressure in second needle control chamber 284 to be maintained well below that in nozzle supply passage 264. Thus, in all versions of the present invention, injection of fuel through the conventional nozzle outlet set is accomplished at least in part by placing the needle control valve in a second position. In the preferred embodiment of the present invention shown in FIG. 2, placement of the needle control valve member in its first position results in the closing hydraulic surface of the second needle valve member to be exposed to high pressure fuel. This allows the first needle valve member which controls the homogenous charge nozzle outlet set to open for a homogenous charge injection event. Likewise, placement of the needle control valve member in its second position results in exposure of the closing hydraulic surface of the first needle valve member to high pressure fuel. This holds the homogenous charge nozzle outlets closed while allowing the conventional nozzle outlets to be opened for a conventional injection event. In the case of the embodiment shown in FIG. 4, the closing hydraulic surfaces are exposed to high or low pressure oil to accomplish the same ends. In each of the example embodiments illustrated, the needle control valve is preferably a three way valve needle control valve. Nevertheless, those skilled in the art will appreciate that other valving structures could be utilized.

The present invention finds potential application in any fuel injection system where there is a desirability to have two different spray patterns available. Preferably, these two different spray patterns correspond to a homogenous charge injection spray pattern and a conventional injection spray pattern. Nevertheless, those skilled in the art will appreciate that the two different spray patterns could merely correspond to the different sized outlets, such as for instance an application of the present invention to a dual fuel engine where pilot injections are used to ignite a gaseous fuel and air mixture, or the engine runs on conventional distillate diesel fuel alone. The present invention preferably has the ability to operate in a purely homogenous mode, a mixed homogenous and conventional mode as shown in FIGS. 6*a–e*, and a pure conventional mode. This should allow an engine equipped with a fuel injection system according to the present invention to achieve low emissions over a broad range of engine operating conditions.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A method of operating a fuel injection system, comprising the steps of:

raising fuel pressure in a fuel injector for an injection event with a pressure control valve, which is a first control valve;

injecting fuel through a homogeneous charge nozzle outlet set of the fuel injector at least in part by placing a needle control valve member, which is part of a second control valve, in a first position;

injecting fuel through a conventional nozzle outlet set of said fuel injector at least in part by placing said needle control valve member in a second position; and reducing fuel pressure in the fuel injector after the injection event.

2. The method of claim 1 wherein said step of placing a needle control valve member in said first position includes a step of exposing a closing hydraulic surface of a second needle valve member to high pressure fuel; and said step of placing said needle control valve member in a second position includes a step of exposing a closing hydraulic surface of a first needle valve member to high pressure fuel.

3. A fuel injector comprising:

an injector body having a low pressure passage and a high pressure passage disposed therein;

a first control valve member, which is a pressure control valve member at least partially positioned in said injector body;

a first needle valve member at least partially positioned in said injector body and including a first closing hydraulic surface;

a second needle valve member at least partially positioned in said injector body and including a second closing hydraulic surface;

at least one of said injector body, said first needle valve member and said second needle valve member defining a first needle control chamber, and said first closing hydraulic surface being exposed to fluid pressure in said first needle control chamber;

at least one of said injector body, said first needle valve member and said second needle valve member defining a second needle control chamber, and said second closing hydraulic surface being exposed to fluid pressure in said second needle control chamber; and a second control valve member, which is needle control valve member at least partially positioned in said injector body, and being moveable between a first position in which said first needle control chamber is fluidly connected to at least one of said low pressure passage and said high pressure passage, and a second position in which said second needle control chamber is fluidly connected to at least one of said low pressure passage and said high pressure passage.

4. The fuel injector of claim 3 wherein said high pressure passage includes a nozzle supply passage; and said low pressure passage includes a fuel circulation passage.

5. The fuel injector of claim 3 wherein said first needle control chamber is fluidly connected to said high pressure passage, and said second needle control chamber is blocked to said high pressure passage, when said needle control valve member is in said first position; and said second needle control chamber is fluidly connected to said high pressure passage, and said first needle control chamber is blocked to said high pressure passage, when said needle control valve member is in said second position.

6. The fuel injector of claim 3 wherein said needle control valve member is a portion of a three way needle control valve.

7. The fuel injector of claim 3 wherein one of said first needle valve member and said second needle valve member is at least partially positioned inside an other of said first needle valve member and said second needle valve member.

8. The fuel injector of claim 3 wherein said injector body includes an actuation fluid inlet and a fuel inlet.

9. The fuel injector of claim 3 including a pressure intensifier.

10. The fuel injector of claim 3 wherein said injector body includes an unobstructed passage extending between one of said first needle control chamber and said second needle control chamber and one of said high pressure passage and said low pressure passage.

11. The fuel injector of claim 3 wherein at least one of said injector body, said first needle valve member and said second needle valve member define a conventional nozzle outlet set; and at least one of said injector body, said first needle valve member and said second needle valve member define a homogeneous charge nozzle outlet set.

12. The fuel injector of claim 3 wherein said high pressure passage includes a nozzle supply passage;

said low pressure passage includes a fuel circulation passage;

said first needle control chamber is fluidly connected to said high pressure passage when said needle control valve member is in said first position;

said second needle control chamber is fluidly connected to said high pressure passage when said needle control valve member is in said second position;

said needle control valve member is a portion of a three way needle control valve; and one of said first needle valve member and said second needle valve member is at least partially positioned inside an other of said first needle valve member and said second needle valve member.

13. A fuel injector comprising:

an injector body having a low pressure passage and a high pressure passage disposed therein;

a first needle valve member at least partially positioned in said injector body and including a first closing hydraulic surface;

a second needle valve member at least partially positioned in said injector body and including a second closing hydraulic surface;

at least one of said injector body, said first needle valve member and said second needle valve member defining a first needle control chamber, and said first closing hydraulic surface being exposed to fluid pressure in said first needle control chamber;

at least one of said injector body, said first needle valve member and said second needle valve member defining a second needle control chamber, and said second closing hydraulic surface being exposed to fluid pressure in said second needle control chamber;

a needle control valve member at least partially positioned in said injector body, and being moveable between a first position in which said first needle control chamber is fluidly connected to at least one of said low pressure passage and said high pressure passage, and a second position in which said second needle control chamber is fluidly connected to at least one of said low pressure passage and said high pressure passage;

a first electrical actuator operably coupled to a pressure control valve member; and a second electrical actuator operably coupled to said needle control valve member.

14. A fuel injection system comprising:

at least one fuel injector that each include a needle control valve member, a first needle valve member and a second needle valve member, and having disposed therein a high pressure passage, a low pressure passage, a first needle control chamber and a second needle control chamber;

said first needle valve member includes a first closing hydraulic surface exposed to fluid pressure in said first needle control chamber;

said second needle valve member includes a second closing hydraulic surface exposed to fluid pressure in said second needle control chamber;

said needle control valve member, which is part of a first control valve, and being moveable between a first position in which said first needle control chamber is fluidly connected to at least one of said low pressure passage and said high pressure passage, and a second position in which said second needle control chamber is fluidly connected to at least one of said low pressure passage and said high pressure passage; and a second control valve, which is a pressure control valve operably associated with each said fuel injector.

15. The fuel injection system of claim 14 wherein said high pressure passage includes a nozzle supply passage; and said low pressure passage includes a fuel circulation passage.

16. The fuel injection system of claim 15 wherein said first needle control chamber is fluidly connected to said nozzle supply passage, and said second needle control chamber is blocked to said nozzle supply passage, when said needle control valve member is in said first position; and said second needle control chamber is fluidly connected to said nozzle supply passage, and said first needle control chamber is blocked to said nozzle supply passage, when said needle control valve member is in said second position.

17. The fuel injection system of claim 16 wherein one of said first needle valve member and said second needle valve member is at least partially positioned inside another of said first needle valve member and said second needle valve member.

18. The fuel injection system of claim 17 wherein each said fuel injector includes a conventional nozzle outlet set; and each said fuel injector includes a homogeneous charge nozzle outlet set.

19. The fuel injection system of claim 18 including a common rail fluidly connected to said at least one fuel injector.

20. The fuel injection system of claim 19 wherein each said fuel injector includes an actuation fluid inlet fluidly connected to said common rail; and each said fuel injector includes a fuel inlet fluidly connected to a source of fuel.

* * * * *